US010106978B1

(12) United States Patent
Graboski et al.

(10) Patent No.: US 10,106,978 B1
(45) Date of Patent: Oct. 23, 2018

(54) RADIANT BARRIER MATERIAL FOR USE IN AN ATTIC INSULATION AND VENTILATION SYSTEM

(71) Applicants: Timothy Michael Graboski, Pompano Beach, FL (US); David Faulkner, Lakewood Ranch, FL (US); Mike Boulding, Davenport, FL (US)

(72) Inventors: Timothy Michael Graboski, Pompano Beach, FL (US); David Faulkner, Lakewood Ranch, FL (US); Mike Boulding, Davenport, FL (US)

(73) Assignee: I-Gloo, LLC, Deerfield Beach, FL (US)

( * ) Notice: Subject to any disclaimer, the term of this patent is extended or adjusted under 35 U.S.C. 154(b) by 200 days.

(21) Appl. No.: 14/066,822

(22) Filed: Oct. 30, 2013

Related U.S. Application Data

(60) Provisional application No. 61/752,129, filed on Jan. 14, 2013.

(51) Int. Cl.
*B32B 3/28* (2006.01)
*E04B 1/76* (2006.01)
*E04B 1/80* (2006.01)

(52) U.S. Cl.
CPC ..... *E04B 1/7675* (2013.01); *E04B 1/80* (2013.01)

(58) Field of Classification Search
CPC ... E04D 13/163; E04D 13/178; E04D 13/152; E04D 13/17; E04D 13/172; E04D 13/174; E04F 1/1308; Y10T 428/24628; Y10T 428/24661; E04B 1/80; E04B 1/7654; E04B 1/64; E04B 1/70; E04B 1/7069; E04B 1/344336; E04B 2001/7691
USPC ..... 428/174, 178; 52/94–95, 302.1, 404.1, 52/407.3–407.5, 404.2–404.3, 173.3, 90.1,
(Continued)

(56) References Cited

U.S. PATENT DOCUMENTS 2,318,820 A 5/1943 Voigt et al.
2,853,222 A * 9/1958 Gallagher ..... B65D 3/14 126/9 A (Continued)

FOREIGN PATENT DOCUMENTS

JP 2010037826 A 2/2010

OTHER PUBLICATIONS

Machine Translation of JP 2010-037826 Mori et al. Obtained from JPO on Jul. 21, 2015.*

(Continued)

*Primary Examiner* — Frank J Vineis
*Assistant Examiner* — Megha M Gaitonde
(74) *Attorney, Agent, or Firm* — Gable Gotwals

(57) ABSTRACT

A barrier material has an upper, radiant barrier layer and a lower, corrugated surface layer. The radiant barrier layer is preferably a metalized film or an aluminum sheet with an emissivity rating 0.1 or less. The metalized film is laminated to one side of a middle layer using a high, heat-resistant adhesive. The corrugated surface layer, which can receive an insulating material, is preferably a corrugated medium. The corrugated medium is laminated to the other side of the middle layer with a water-resistant adhesive. The middle layer is preferably a fire-resistant, kraft linerboard. The barrier creates an air space or plenum between an external structure and the insulating material designed to prevent heat transfer between an insulated space and the external structure.

6 Claims, 1 Drawing Sheet

(58) Field of Classification Search
USPC ..... 52/92.1–92.3, 506.04–506.06; 126/621; 454/363
See application file for complete search history.

(56) References Cited

U.S. PATENT DOCUMENTS

| | | | | | |
|---|---|---|---|---|---|
| 3,240,144 | A * | 3/1966 | Lind | E04D 13/152 | 454/260 |
| 3,404,748 | A | 10/1968 | Bjorksten | | |
| 4,290,247 | A * | 9/1981 | Alderman | E04D 13/17 | 165/53 |
| 4,401,706 | A * | 8/1983 | Sovilla | B32B 3/28 | 156/210 |
| 4,635,419 | A * | 1/1987 | Forrest | E04D 13/172 | 454/185 |
| 4,934,338 | A | 6/1990 | Hollick et al. | | |
| 5,205,473 | A * | 4/1993 | Coffin, Sr. | B65D 3/22 | 206/813 |
| 5,560,157 | A | 10/1996 | Rotter | | |
| 5,992,112 | A * | 11/1999 | Josey | 52/309.8 | |
| 6,797,356 | B2 | 9/2004 | Zupon et al. | | |
| 7,094,145 | B2 | 8/2006 | Rye et al. | | |
| 7,302,776 | B2 | 12/2007 | Duncan et al. | | |
| D581,511 | S | 11/2008 | Rosten et al. | | |
| 7,856,764 | B2 | 12/2010 | Kortuem et al. | | |
| 7,861,467 | B2 | 1/2011 | Rosten et al. | | |
| 8,347,562 | B2 | 1/2013 | Morris et al. | | |
| 2003/0111523 | A1 * | 6/2003 | Haugan | B65D 5/248 | 229/125.19 |
| 2006/0117686 | A1 | 6/2006 | Mankell et al. | | |
| 2008/0163565 | A1 | 7/2008 | Toas | | |
| 2008/0202041 | A1 | 8/2008 | Dillon | | |
| 2009/0044797 | A1 | 2/2009 | Klement | | |
| 2013/0074428 | A1 | 3/2013 | Allen et al. | | |
| 2013/0247489 | A1 | 9/2013 | Janesky | | |

OTHER PUBLICATIONS

Written translation of JP 2010-037826 Mori et al. Obtained Aug. 3, 2015.*

Douglas Pencille, "Proper Attic Ventilation", Mar. 5, 2001, Publisher: www.dspinspections.com/atticventing.htm.

* cited by examiner

RADIANT BARRIER MATERIAL FOR USE IN AN ATTIC INSULATION AND VENTILATION SYSTEM

CROSS-REFERENCE TO PENDING APPLICATIONS

This application claims priority to U.S. Prov. Pat. App. No. 61/752,129 filed, Jan. 14, 2013.

BACKGROUND OF THE INVENTION

The present invention relates generally to an improved attic and under-roof deck insulation system. More particularly, the present invention relates to a radiant barrier material for use in an attic insulation system that provides the benefits of both a conventional ventilated attic system and a sealed attic system.

To date, there are no effective means of preventing a spray polyurethane insulation or its equivalent from coming into contact with the underside of the roof decking or sheathing. There are ribbed baffle vents or panels made of vacuum molded polyvinyl chloride film which are installed between the rafters and the roof sheathing and provide a passage for air to flow from the building to the roof vent (see e.g. U.S. Pat. No. 7,861,467 B2; see also e.g. U.S. Pat. No. D581,511 S). Other types of ribbed baffles are placed between the rafters on the underside of the sheathing (see e.g. U.S. Pat. No. 7,856,764 B2; see also e.g. U.S. Pat. No. 7,094,145 B2).

None of the prior art panels creates an uninterrupted plenum or air barrier below the sheathing which spans the height of the rafters (thereby creating an air barrier), nor do they create a radiant barrier between the sheathing and panel. Additionally, none of the panels is water-resistant or fire-rated (retardant) nor intended to serve as a lath material for a spray polyurethane insulation or its equivalent. Last, the panels do not provide a monolithic assembly nor do they reinforce the building envelope.

SUMMARY OF THE INVENTION

A barrier material made according to this invention integrates a radiant barrier layer with a fire retardant layer to provide a structure for under roof deck ventilation in addition to receiving an insulating material. Preferably, the barrier material receives a Class 1/Class A rating as specified under ASTM E84. The barrier material is comprised of an upper, radiant barrier (or reflective surface) layer and a lower, corrugated surface layer.

The radiant barrier layer should meet the requirements of ASTM C1313 and. is preferably a metalized film or an aluminum sheet with an emissivity rating 0.1 or less. The radiant barrier layer is laminated to one side of a middle layer using a high, heat-resistant adhesive (e.g. up to 325 degrees Fahrenheit)

The corrugated surface layer is preferably a fire-resistant corrugated medium. The corrugated medium is laminated to the other side of the middle layer with a water resistant, adhesive.

The middle layer is preferably a fire-resistant kraft linerboard

The barrier material can be connected to the bottom side of the rafters (or between rafters) in an attic space with the upper layer of the barrier material spaced apart from and facing, but not touching, the inner side of the roof decking or sheathing material. Preferably, the barrier material is sized to span the center-to-center distance of adjacent pairs of rafters. Fiberglass insulation, spray polyurethane foam, or the like may then be applied to the lower layer.

ELEMENTS AND NUMBERING USED IN THE DRAWINGS AND DETAILED DESCRIPTION

Figure 1:
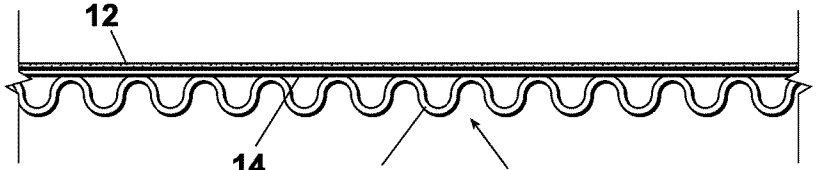
FIG. 1 is a cross-section view of a preferred embodiment of a barrier material made according to this invention. The barrier material includes an upper, radiant barrier (reflective surface) layer and a lower, corrugated surface layer.

10 Barrier material (radiant heat and spray insulating foam barrier assembly)
12 Uppermost (topmost) layer or surface
14 Middle layer
16 Lowermost (bottommost) layer or surface
20 Hybrid sealed attic insulation and ventilation system
22 Attic space
24 Ceiling/floor joists
26 Roof rafters or truss top chord
28 Roof decking or sheathing
30 Bottom or inner (under) side of 28
32 Roofing felt or underlayment
34 Weather-proof covering or roof system
38 Bottom side of 26
40 Insulating material
42 Air Chamber (ventilation plenum)
43 Exhaust plenum
44 Lower vents or intake ventilators
46 Upper vents or exhaust ventilators
52 Interior conditioned space

DETAILED DESCRIPTION OF THE PREFERRED EMBODIMENTS

Referring to FIG. 1, a preferred embodiment of a barrier material 10 made according to this invention is comprised of an upper, radiant barrier (reflective surface) layer 12 and a lower, corrugated surface layer 16. Preferably, the barrier material receives a Class 1/Class A rating as specified under ASTM E84.

Upper layer 12 is a barrier surface and preferably one that meets the requirements of ASTM C1313. In a preferred embodiment, the layer 12 is a metalized film or an aluminum sheet with an emissivity rating of 0.1 or less. Upper layer 12 is laminated to one side of middle layer 14 using a high heat-resistant adhesive. Preferably, the high heat-resistant adhesive is rated up to 325° F. Adhesives having a higher heat-resistant rating may be used.

Middle layer 14 is preferably fire retardant and water resistant. In a preferred embodiment, middle layer 14 is a kraft linerboard. The linerboard may have a weight of at least 33 lbs/1000 sq-ft.

Lower layer 16 is a reinforced surface and is preferably a corrugated medium. The corrugated medium may have a weight of not less than 23 lbs/1000 sq-ft. Lower layer 16 is laminated to the other side of the middle layer 12 using a water-resistant adhesive.

Figure 2:
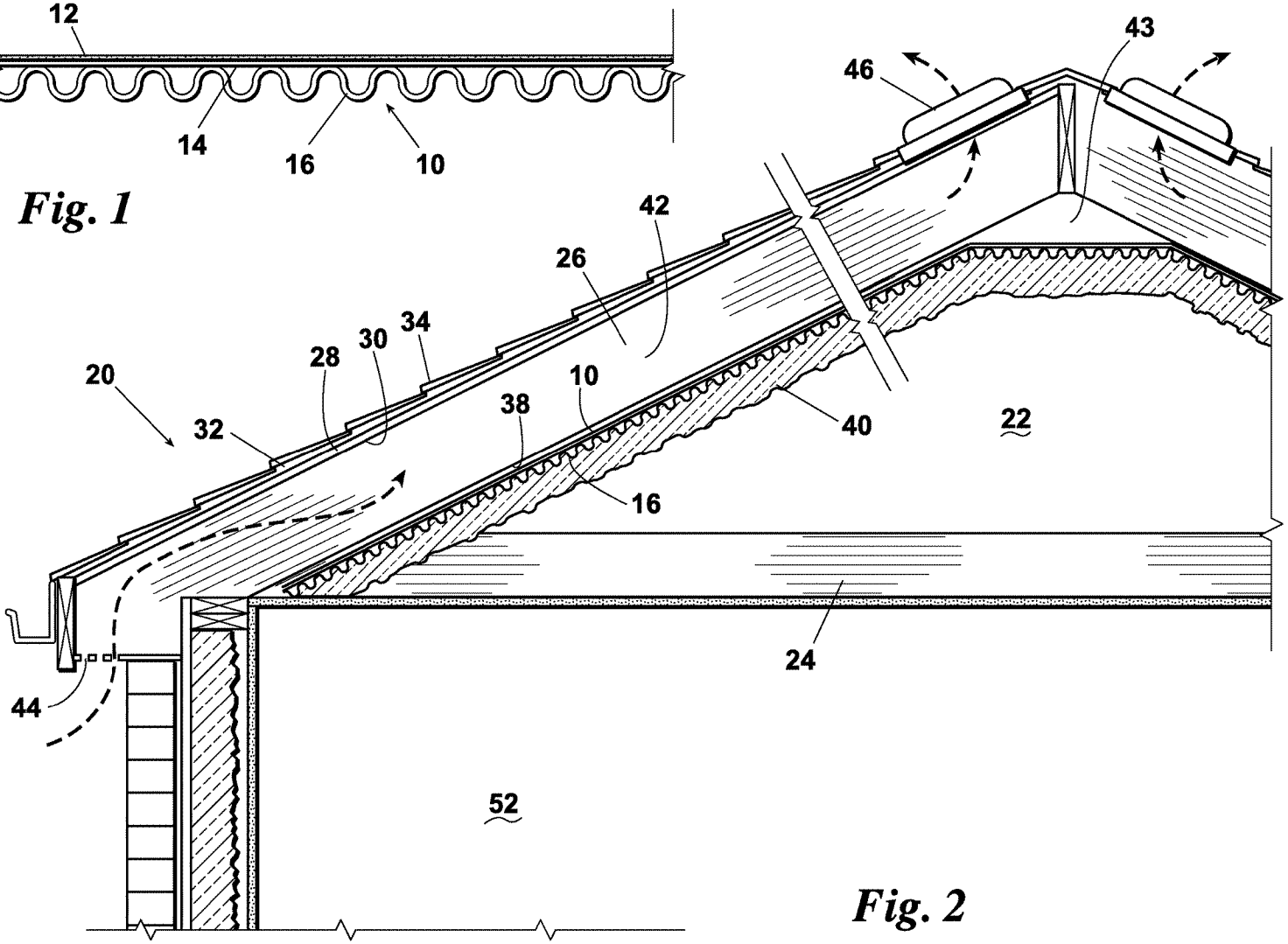
FIG. 2 is a view of the barrier material of FIG. 1 when installed as part of an attic insulation system. The barrier material may be installed in other applications in which an air space or plenum is desired between an external structure and insulating material designed to prevent heat transfer between an interior insulated space and the structure.

Referring now to FIG. 2, barrier material 10 can be a part of a system 20 used to insulate an attic space 22 typically located between the ceiling/floor joists 24 and the roof rafters (or truss top chords) 26. The roof rafters 26 support the roof decking 28 which, in turn, is typically overlaid with some type of weather-proof covering 34, such as composite shingles, tiles, metal, or the like. A roofing felt or underlayment 32 may also be located between covering 34 and the decking 28.

Barrier material 10 is attached to the bottom side 38 of the rafters 26 (or between rafters) so that the upper, radiant barrier layer 12 is facing, but not touching, the inner side 30 of the roof decking 28 and the lower, corrugated surface layer 16 is facing away and toward the ceiling/floor joists 24 (i.e. attic space 22). Preferably, radiant barrier material 10 is sized to span the center-to-center distance of adjacent rafters 26.

This arrangement provides an air chamber or plenum 42 between the decking 28 and the upper, radiant barrier layer 12. In a preferred embodiment, plenum 42 spans the distance between adjacent pairs of rafters 26, with the distance between the upper, radiant barrier layer 12 and the inner side of the roof decking 28 being the height of board used for the rafters 26 (e.g. 6 inches). An insulating material 40, such as but not limited to fiberglass insulation, spray polyurethane insulation or the like, may then be applied to the lower corrugated surface layer 16.

The installed barrier material 10 creates a pathway or plenum 42 located between the upper, radiant barrier layer 12, rafters 26, and roof decking 28 for air to circulate from the lower (soffit or eave) vents 44 upward to the upper (roof or exhaust) vents 46. The upper vents 46 may be any type of roof vent commonly used, including but not limited to ridge vents, wind driven turbines, solar powered ventilators and electrically driven fan vents. The barrier material 10 can also be installed to create an exhaust plenum 43 toward the ridge portion of the roof.

The circulation of air through the plenum 42 allows moisture to evacuate from under the roof decking 28 and mitigates warping of the decking 28, deterioration of the decking 28, and pre-failure of the roof covering 34. This air circulation also eliminates ice damming on the top surface of the roof covering 34. Ice damming can also lead to roof damage as well water infiltration to the roof and building structure.

The barrier material 10 and insulation material 40 can extend over the entire surface area defined by adjacent rafters 26 or a portion of that surface area. Once in place, the attic space 22 may be climate-controlled to make it more suitable for habitation or storage.

The barrier material 10 may be installed as a part of other systems in which an airspace or plenum 42 is desired between an external structure and the insulating material designed to prevent heat transfer between an interior insulated space and the structure.

The preferred embodiments described above are not all possible embodiments of the invention. Therefore, the scope of the invention is defined by the following claims. Those claims cover elements which may not be specifically listed in the claims but represent trivial differences from, or are equivalent to, the specific elements listed in the claims.

What is claimed:

1. A radiant heat and spray foam insulation barrier and ventilation air flow plenum assembly consisting of:

a flat topmost layer consisting of a radiant barrier reflective surface having an emissivity rating of 0.1 or less;

a bottommost layer consisting of a fire-resistant wavy surface;

a heat-resistant first adhesive rated to at least 325° F.;

a water-resistant second adhesive; and a flat middle layer consisting of a fire- and water-resistant flat kraft linerboard bonded by the first adhesive directly to an opposing inward-facing surface of the flat topmost layer and by the second adhesive to a contacting opposing inward-facing surface of the bottommost layer;

the radiant heat and spray foam insulation barrier and ventilation air flow plenum assembly:

capable of forming a bottom of a ventilation air flow plenum, the ventilation air flow plenum located adjacent to an underside of a roof decking and extending between adjacent roof rafters from a lower soffit vent to an upper roof vent and to another lower soffit vent; and is oriented so the flat topmost layer is roof deck-facing to reflect radiant heat entering the ventilation air flow plenum and the wavy bottommost layer is attic floor-facing to receive spray foam insulation.

2. A radiant heat and spray foam insulation barrier material and ventilation air flow plenum assembly according to claim 1 wherein the bottommost layer has weight of at least 23 lbs/1000 sq. ft.

3. A radiant heat and spray foam insulation barrier material and ventilation air flow plenum assembly according to claim 1 wherein the flat middle layer has a weight of at least 33 lbs/1000 sq. ft.

4. A radiant heat and spray foam insulation barrier and ventilation air flow plenum assembly consisting of:

a flat topmost layer consisting of a radiant barrier reflective surface having an emissivity rating of 0.1 or less;

a bottommost layer consisting of a fire-resistant wavy surface;

a heat-resistant first adhesive rated to at least 325° F.;

a water-resistant second adhesive; and a flat middle layer consisting of a fire- and water-resistant flat kraft linerboard bonded by the first adhesive directly to an opposing inward-facing surface of the flat topmost layer and by the second adhesive to a contacting opposing inward-facing surface of the bottommost layer;

the radiant heat and spray foam insulation barrier and ventilation air flow plenum assembly:

capable of forming a bottom of a ventilation air flow plenum, the ventilation air flow plenum located adjacent to an underside of a roof decking and extending between adjacent roof rafters from a lower soffit vent to an upper roof vent and to another lower soffit vent; and is oriented so the flat topmost layer is roof deck-facing and the wavy bottommost layer is attic floor-facing.

5. A radiant heat and spray foam insulation barrier and ventilation air flow plenum assembly according to claim 4, the bottommost layer having a weight of at least 23 lbs/1000 sq. ft.

6. A radiant heat and spray foam insulation barrier and ventilation air flow plenum assembly according to claim 4 the fire- and water-resistant flat kraft linerboard having a weight of at least 33 lbs/1000 sq. ft.

* * * * *